US006189272B1

(12) United States Patent
Deiss et al.

(10) Patent No.: US 6,189,272 B1
(45) Date of Patent: Feb. 20, 2001

(54) MULTI LEVEL VEHICLE SERVICE SYSTEM

(75) Inventors: H. Dieter Deiss, 3000 Palisades Rd., Calistoga, CA (US) 94515; Kenneth W. Nelson, 753 Lewis Way, Napa, CA (US) 94559

(73) Assignees: H. Dieter Deiss, St. Helen; Kenneth W. Nelson, Napa, both of CA (US)

( * ) Notice: Under 35 U.S.C. 154(b), the term of this patent shall be extended for 0 days.

(21) Appl. No.: 09/316,968

(22) Filed: May 24, 1999

(51) Int. Cl.[7] ..... E04H 1/00

(52) U.S. Cl. ..... 52/236.3; 52/174; 52/741.2; 52/745.01; 182/130; 182/132

(58) Field of Search ..... 52/174, 175, 263.3, 52/741.2, 745.01; 182/130, 132, 222; 184/1.5; 137/234.6

(56) References Cited

U.S. PATENT DOCUMENTS

| | | | | |
|---|---|---|---|---|
| 835,059 | | 11/1906 | Curley . | |
| 1,357,022 | | 10/1920 | Bahls . | |
| 1,440,645 | * | 1/1923 | Sullivan | 182/132 X |
| 1,633,280 | * | 6/1927 | Nicholson | 52/174 |
| 1,654,073 | * | 12/1927 | Fagan | 52/174 X |
| 1,722,818 | | 7/1929 | Mugler . | |
| 2,009,384 | | 7/1935 | Brett . | |
| 2,898,641 | | 8/1959 | Battista . | |
| 3,079,871 | * | 3/1963 | Brodie | 52/174 X |
| 3,256,955 | * | 6/1966 | Izmirian et al. | 182/130 X |
| 3,354,707 | * | 11/1967 | Born | 52/174 X |
| 3,552,521 | | 1/1971 | Tate . | |
| 3,599,382 | | 8/1971 | Stone . | |
| 3,684,058 | * | 8/1972 | Brown | 182/132 |
| 3,756,419 | | 9/1973 | Dean . | |
| 3,942,297 | | 3/1976 | Kitagawa . | |
| 4,188,985 | | 2/1980 | Osterman . | |
| 4,284,173 | | 8/1981 | Patterson . | |
| 4,618,029 | | 10/1986 | Lowry . | |
| 4,724,875 | | 2/1988 | Baldwin et al. . | |
| 4,789,047 | * | 12/1988 | Knobloch | 52/174 X |
| 5,033,489 | | 7/1991 | Ferre et al. . | |
| 5,044,467 | * | 9/1991 | Heiden | 182/130 |
| 5,054,580 | | 10/1991 | Cheek . | |
| 5,701,706 | * | 12/1997 | Kreysler et al. | 52/174 X |

FOREIGN PATENT DOCUMENTS

| | | | | |
|---|---|---|---|---|
| 899 403 | * | 5/1945 | (FR) | 52/174 |

* cited by examiner

*Primary Examiner*—Laura A. Callo
(74) *Attorney, Agent, or Firm*—Thomas M. Frieburger

(57) ABSTRACT

A multi-level vehicle servicing system includes site-erectable units each with four levels, to facilitate vehicle repairs by several technicians at the same time. Each unit includes vertical structural members, horizontal supports, flooring, tool storage, parts storage, panels, stairs, ladders, ramps, lifting mechanisms to raise the vehicle off its wheels, and mechanisms to facilitate removal of heavy repair components to other levels below. Lighting, power, compressed air, fluid delivery and extraction, and fire suppression systems are integrated in the system of components. The system is erected on a conventional building floor and is free-standing, independent of the building structure itself. The modular apparatus is installed without major modifications to an existing building of appropriate size and structural compatibility. Several of the four-level units can be stacked and any number may be combined in any horizontal configuration.

20 Claims, 19 Drawing Sheets

FIG. 12
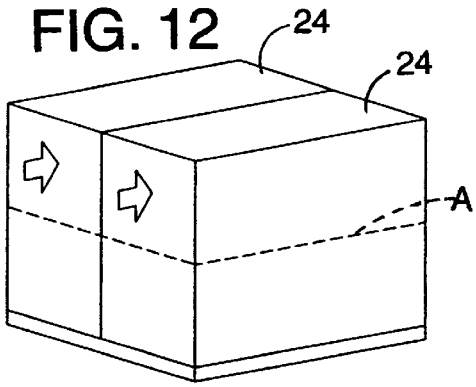
FIG. 13
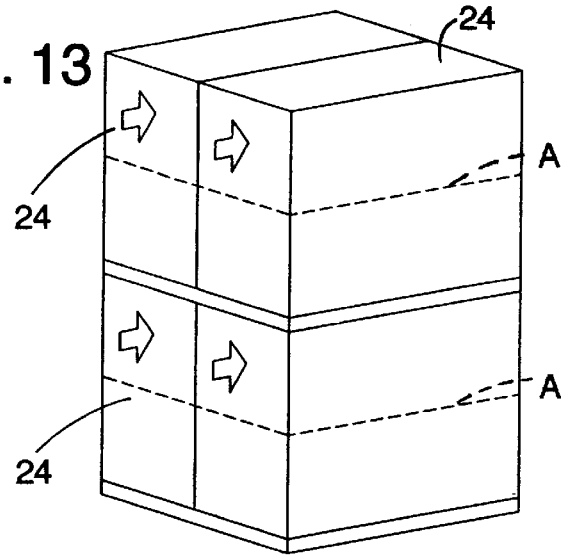
FIG. 14
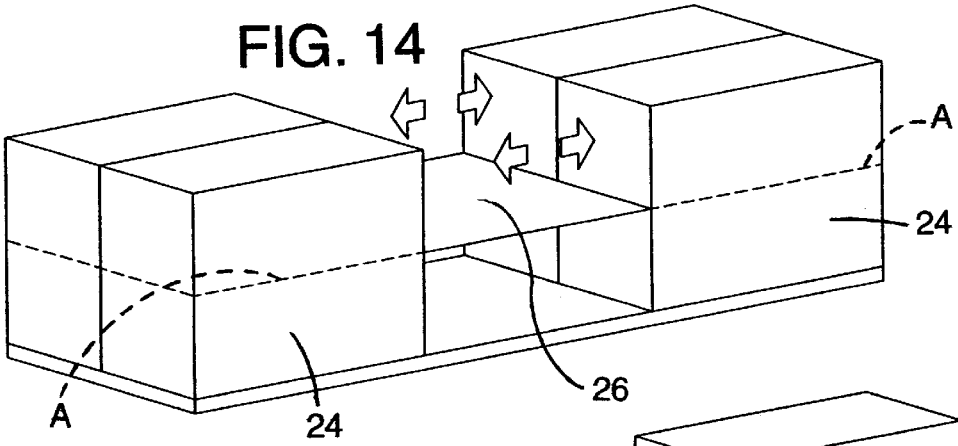
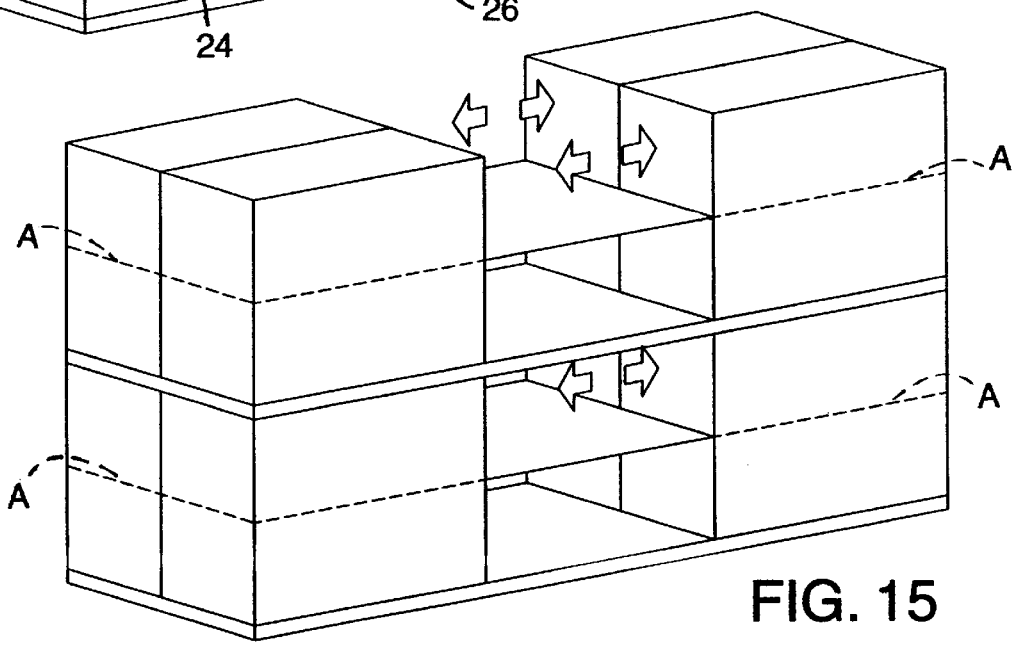
FIG. 15

MULTI LEVEL VEHICLE SERVICE SYSTEM

BACKGROUND OF THE INVENTION

The present invention relates in general to motor vehicle repair and servicing systems, and in particular to a multi-level motor vehicle repair system that can be shipped as components and assembled on site without major building modification. The system includes integration of a parts storage and a parts delivery method to the work area so that parts storage is no longer a remote and separate function.

There is an increasing need for more efficient use of manpower and building area due to economic pressure to reduce operating costs of motor vehicle repair facilities. Economies gained by combining work operations at the vehicle repair lift and work bay have been documented by the development of other multi-level service applications which require building modification to accomplish a complete and proper installation. For example, some servicing systems require a full-depth pit, 6 or 7 feet in depth, within which the service worker stands to change oil, lubricate the automobile or perform other services at the underside of the vehicle. Others require half-depth pits which are used in conjunction with a ramp and lift system which elevate the vehicle an amount sufficient to allow work on the vehicle from in the pit.

As examples of previous vehicle servicing systems, see U.S. Pat. Nos. 5,054,580, 5,033,489, 4,724,875, 4,618,029, 4,284,173, 4,188,985, 3,942,297, 3,756,419, 3,599,382, 3,552,521, 2,898,641, 2,009,384, 1,722,818, 1,357,022, 835,059.

Other examples of automotive servicing systems, permitting a worker to service the vehicle from below and from other positions, include a metal framework designed to be positioned in a basement, below a vehicle-supporting floor, produced by Unilube Systems, Ltd. of Arlington, Tex.; and a half-pit vehicle lift servicing system marketed under the name Autop by Stammhaus Franz Hörnstein GmbH and Co. Kg of Heilbronn, Germany.

Prior vehicle servicing apparatus and systems have not provided a conveniently used three-level or four-level servicing facility which is on-site erected from individual transported components into a facility which is placed on a floor, not requiring a basement or pit, with the vehicle or vehicles supported on an upper level which is a part of the erected structure. The prior art also failed to provide for convenient location of parts and servicing equipment at a lowermost level at which a number of service personnel are located and can get convenient access to the parts and equipment.

SUMMARY OF THE INVENTION

The present invention is directed to a multi-level motor vehicle service system for simultaneous repair processes by several technicians at a single location. The system is designed as a kit of parts with components that are pre-manufactured and then shipped to the site for assembly, erection, and installation. Objects of the invention are accomplished by assembling the various component parts on site into a freestanding, self-supporting, and fully functioning unit having four major levels where work processes are performed. The vehicle to be repaired is delivered to the individual work station by an operator driving the vehicle, workers manually pushing a disabled vehicle, manually operated power assist in contact with the vehicle, an unmanned remote controlled power transfer system, or any combination thereof.

Metal structural elements provide a framework that may be connected together at the site without welds and with bolted or other methods of connection that provide major structural integrity of the system. Other system components are attached to the structure such as stairs for moving between levels, floors for work platforms, movable work steps, areas for tool trays, special tool storage, computer terminals, technicians' lockers, technicians' tool storage, testing equipment, waste fluid collection equipment and fluid replacement equipment, lighting, electrical service, compressed air and other utilities.

In one preferred embodiment the system allows for two or more complete assemblies to be joined horizontally and stacked vertically utilizing previously underutilized building volume by providing additional work levels without major building modification.

The preferred system has four levels which can be identified from top to bottom as first to fourth level or level A to level D. The top level (first level or level A) is the level on which the vehicle sits and provides for the following tasks to be performed: Change engine oil and filter. Replace fuel filter. Service cooling system. Replace spark plugs. Inspect spark plug wires. Inspect air cleaner and intake system. Replace air filter and crankcase ventilation filters. Check throttle body mounting bolt torque and linkage. Inspect engine accessory drive belt. Inspect exhaust gas re-circulation system. Check engine timing and distributor. Inspect brake system and brake fluid level. Check windshield washer fluid level. Check hydraulic clutch fluid level. Check power steering fluid level. Check transmission fluid level. Inspect electronic vacuum regular valve. Inspect evaporative control system. Inspect shields and under hood insulation. Inspect thermostatically controlled engine cooling fan. Inspect CDRV system. Inspect exhaust pressure regulator valve. Inspect windshield wiper blades. Inspect instruments. Inspect alarms. Inspect window controls. Inspect air conditioning and heating. Inspect automatic mirrors. Inspect sun roof mechanism. Inspect seat belts and airbags. Inspect all exterior and interior lights.

From the B level (second or upper intermediate level), the following may be done: Check tire inflation and rotate wheels. Inspect brakes. Inspect fuel tank, cap, and lines. Check door looks, lubricate key lock cylinders. Lubricate body/suspension. Check starter switch. Check brake transmission shift interlock. Check steering column lock. Check parking brake and automatic transmission park mechanism. Inspect steering, suspension, and front drive axle boots and seals. Repack front wheel bearings.

From the C or third level (lower intermediate level), a worker can: Change engine oil and filter. Lubricate chassis. Lubricate body. Service cooling system. Service transmission or transaxle. Perform service on rear axle. Inspect fuel tank, cap, and lines. Inspect hydraulic clutch system. Lubricate clutch fork ball stud. Inspect steering, suspension, and front wheel driver axle boots and seals. Inspect exhaust system. Inspect shields. Inspect brake system. Check for oil leaks.

At the fourth level, which is the bottom or D level, a floor on which the apparatus rests, the facility provides for: Fast moving parts storage. Engine component repair. Engine component assembly. Transmission repair. Transmission component assembly. Suspension repair. Wheel bearing repair. Brake lathe. Parts cleaning. Core refinishing. Electrical component diagnostics and repair.

Repair technicians move between levels via a series of stairs. Stairs and rails are component parts of the apparatus and system. The stairs are attached to structural members and can act as bracing members.

The vehicle can be elevated so that its tires are several inches above level A by vehicle jacks that are integral to level A. When the vehicle is raised, the technician on level B performs repairs that require the wheel assemblies to spin free or be removed while all the other areas of the vehicle remain accessible for other tasks.

An opening in the floor system of level A directly below the vehicle allows a technician operating on level C access to the vehicle undercarriage without moving the vehicle or raising it above level A. Fold out or sliding steps and platforms from the sides of level A allow the technician to access the vehicle interior and engine compartment from level B when needed. Replacement fluids for maintenance and repair are dispensed from either side and near the engine compartment. At level A, and accessed from level C, is a fluid collection tray that moves on rollers or pivots the length of the opening in level A.

On level A, in front of the vehicle, there is a removable panel which allows heavy vehicle components (including the engine) to be lowered to level D for disassembly and repair.

Stacked at one end of the multi-level service system bay is a work center for level A and one for level D. These are comprised of a modular furniture system that includes tool storage units, personal storage units, reference library, testing equipment, computer terminal, parts storage, dumbwaiter, and work bench.

Below the floor panel of level C and supported on level D is a tool and parts storage system comprised of shelves, drawers, and specialty tool storage. Adjacent on level D is a parts storage system including adjustable shelves and bins attached to the system structure. Also accessed from level D are modular work benches.

It is among the objects of the invention to improve over prior vehicle servicing systems, with a completely modular apparatus, quickly and easily site-erectable, which is essentially free-standing on a building floor and providing multiple work levels for the mechanics or other service persons, including the top level on which the vehicle rests. These and other objects, advantages and features of the invention will be apparent from the following description of a preferred embodiment, considered along with the accompanying drawings.

DESCRIPTION OF THE DRAWINGS

FIGS. 12–15 are diagrammatic perspective views indicating several arrangements in which the surfacing units can be arranged side-by-side and stacked in a vehicle servicing facility.

DESCRIPTION OF THE PREFERRED EMBODIMENTS

Figure 1:
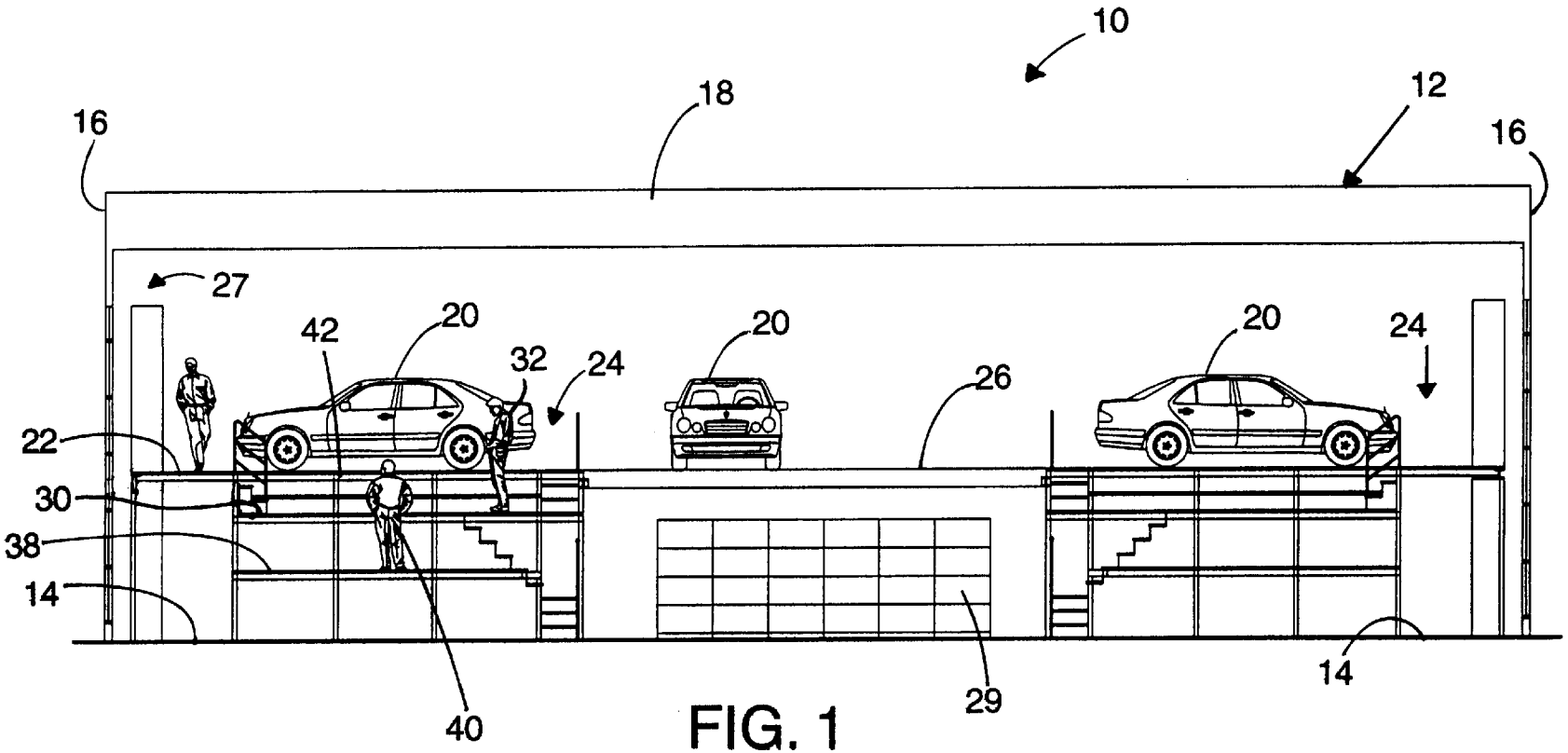
FIG. 1 is an elevational view in section showing an embodiment of a multi level vehicle servicing facility according to the invention, including multiple units of a modular apparatus within the facility.
Figure 3:
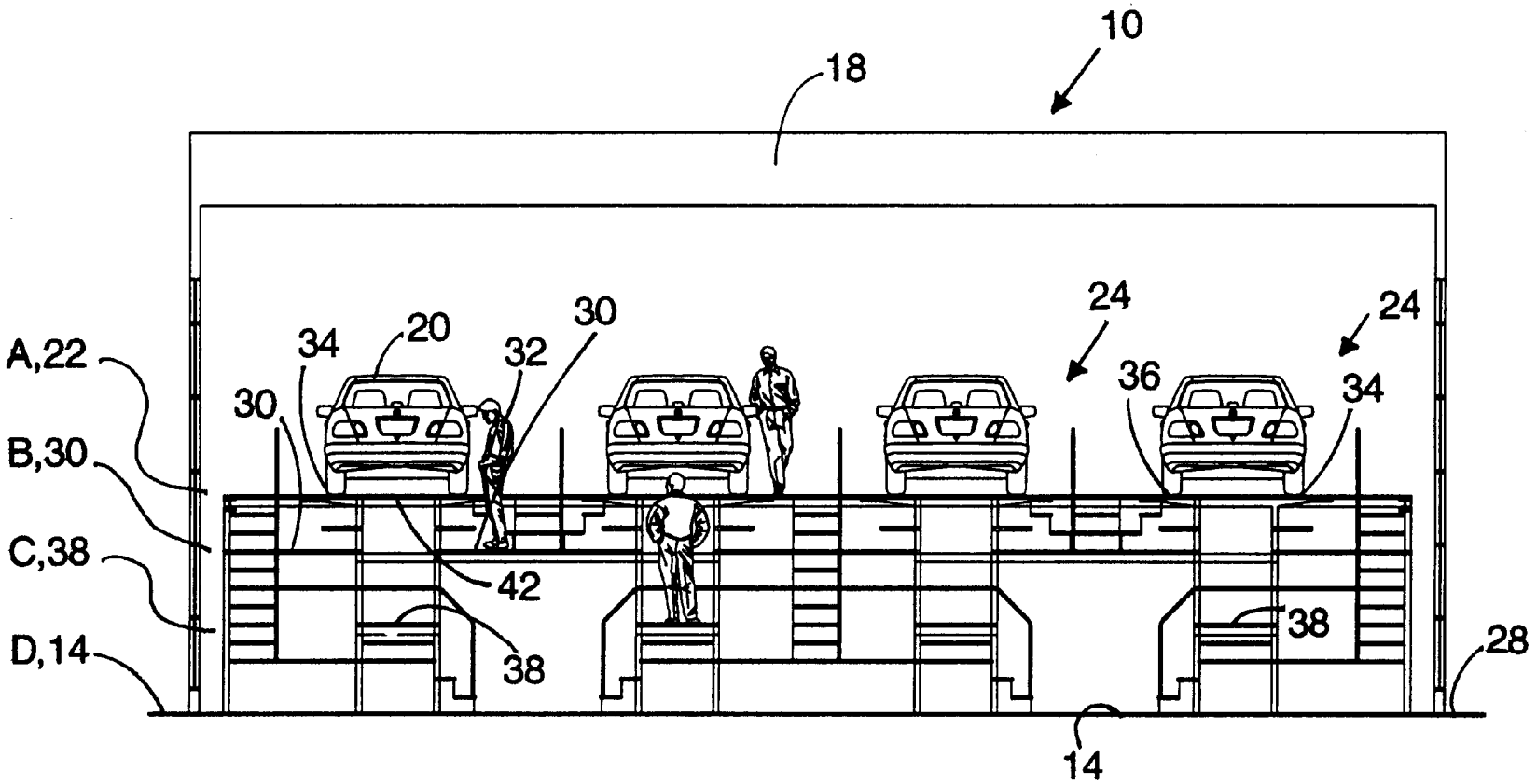
FIG. 3 is an elevation view in section, taken from a direction at right angles to that of FIG. 1, generally along the line 3—3 in FIG. 2, showing the facility.

FIG. 1 shows in cross section an automotive servicing facility 10, preferably housed within a building 12 having a floor 14, walls 16 and a roof 18. Several cars 20 are shown within the facility, positioned on a first level 22, sometimes referred to as the A level of the facility. As seen in FIGS. 1 and 3 of the drawings (FIG. 3 being a sectional view at right angles to FIG. 1), the facility 10 includes a series of field-erectable automotive servicing apparatus or units 24, which are free-standing on the building floor 14, these units 24 each comprising a framework with platforms, the units providing the first work level 22 on which the vehicles are located, rather than a floor of the building providing this level. Preferably the units 24 are not connected to the building walls, but minor, non-load-bearing connections can be made as desired. Thus, the building is basically unmodified to establish the vehicle servicing facility 10, and as seen below, if and when the facility is to be removed and the building used for other purposes, this is easily accomplished without leaving unwanted building modifications.

Figure 2:
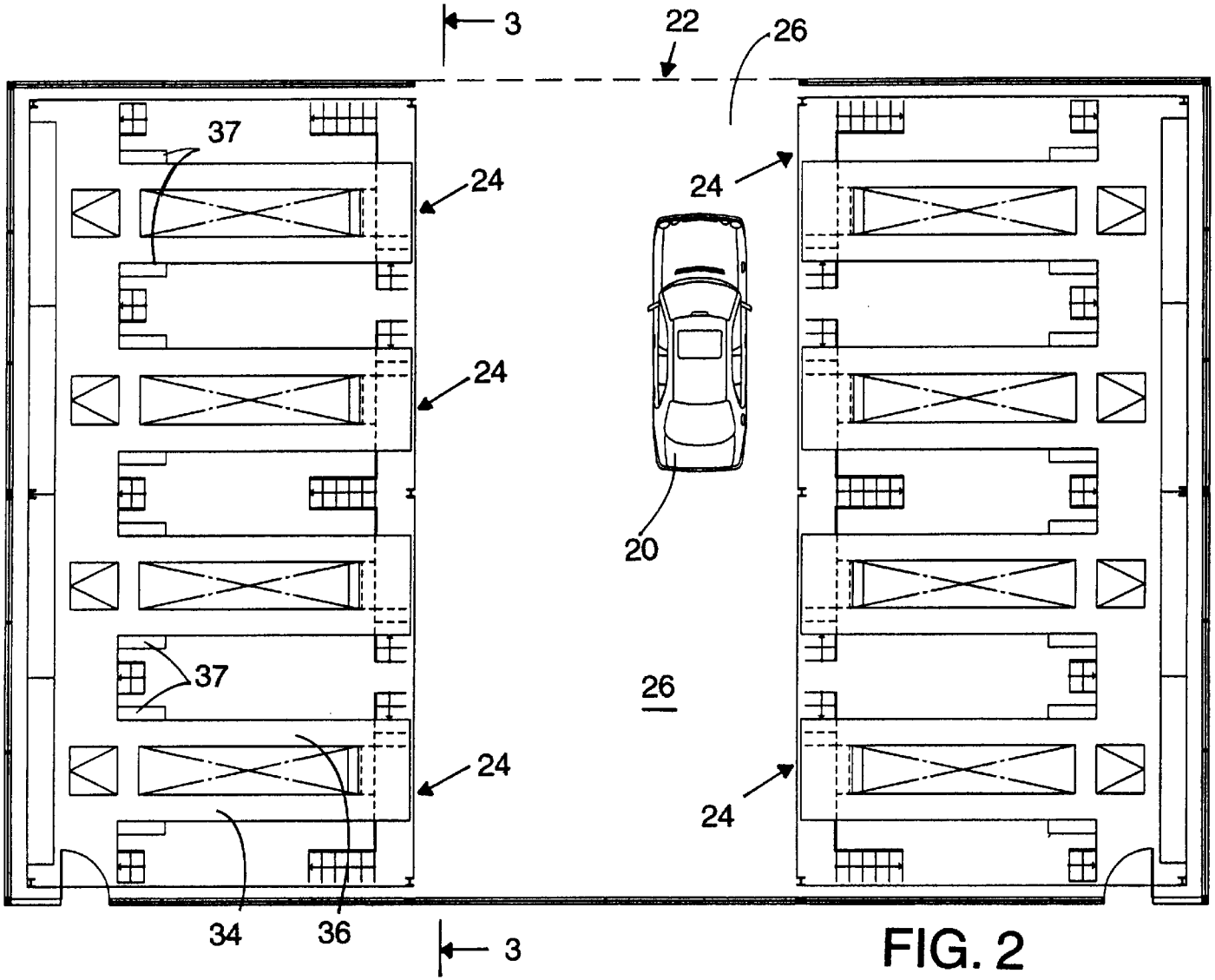
FIG. 2 is a plan view, somewhat schematic, showing the upper level of the facility.

In FIG. 1 an aisle or corridor floor 26 is shown supported between a series of multi level servicing units 24, each row of such units being adjacent to a wall 16. A row of four of such units is shown in the orthogonal sectional view of FIG. 3. FIG. 2 shows in plan view an example of an upper or A level of a facility 10 having rows of four such units 24 on each side of the building, with a vehicle entry or aisle floor 26 between them. The cars 20 are brought to the A level 22, which in this form of the system is elevated above the ground floor of the building and the ground 28 outside, by an appropriate ramp or lift arrangement, not shown in FIGS. 1–3. FIG. 1 also shows a storage unit 29 on the building floor (D level), under the elevated floor 26. This represents equipment or storage for parts or tools.

Figure 3A:
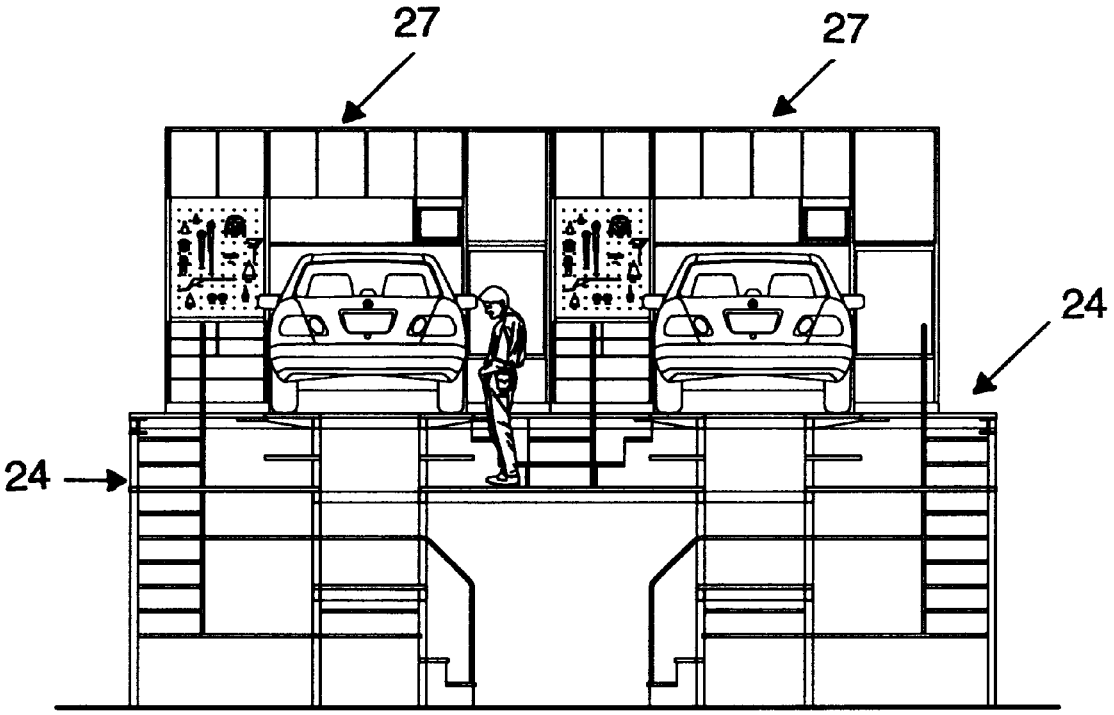
FIG. 3A is an elevation view similar to FIG. 3, omitting the building and only showing two service units.

In FIG. 3 the units 24 are seen side-by-side in the building, connected together to form a part of the free-standing servicing facility. FIG. 3A shows several units side-by-side with cabinets generally indicated at 27 (also seen in FIG. 1), on the A level and near the front of the car. The building is not shown in FIG. 3A.

Figure 5:
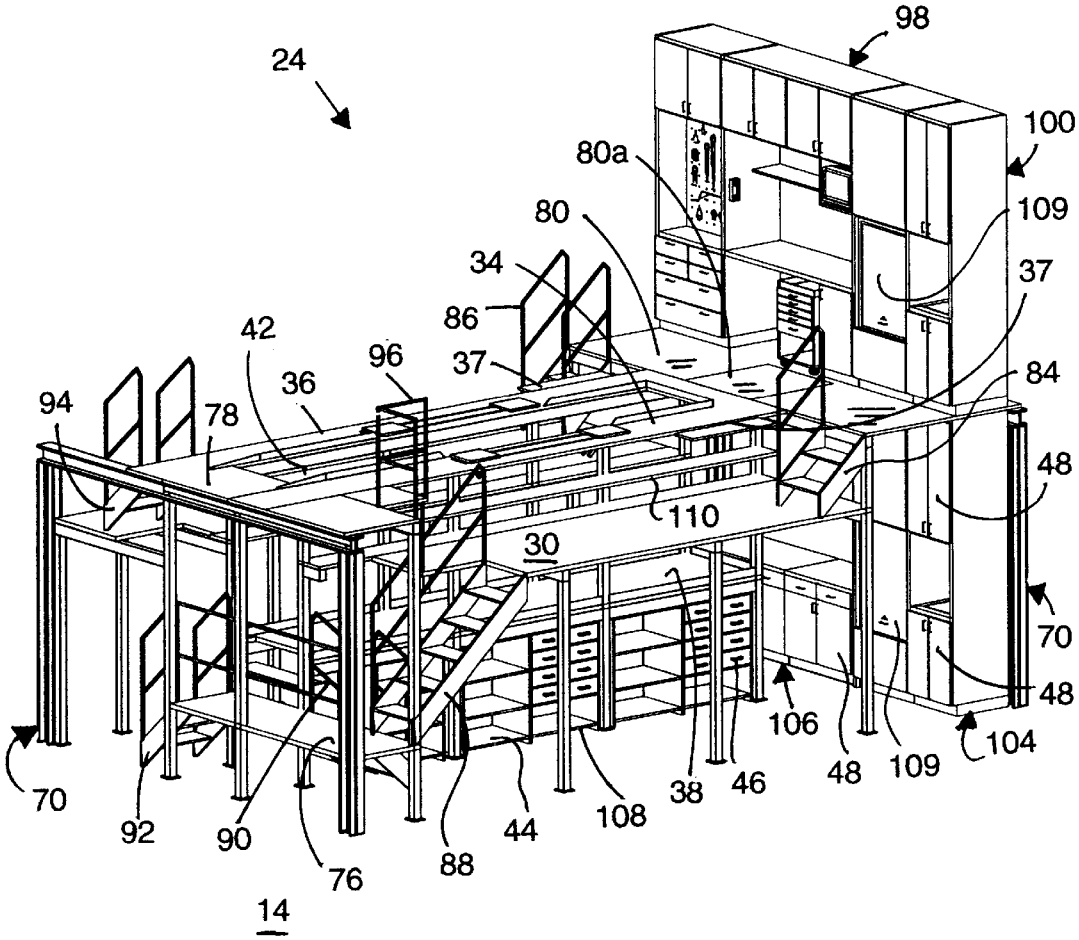
FIG. 5 is a view in perspective showing one unit of the vehicle servicing apparatus, made up of assembled components, and which can form one of the units shown in the facilities of FIGS. 1–4.

A single unit 24 is shown in FIG. 5. Some of the units are opposite-hand from the units shown in FIG. 5, and from one another, as seen, for example, at left and right sides of FIG. 3. This relates primarily to details regarding location of stairs and access platforms, and the units 24 may be made in such a way that they can be erected for either configuration.

The A level or first level 22 is the level on which the car resides and on which services are performed on the engine as well as on other components of the vehicle discussed above. It may be about 8½ to 9 feet (about 260–280 cm) above the floor 14. Below the A level 22 is a second level or B level 30, approximately 2 feet (65–70 cm) below the A level. As shown in FIGS. 1 and 3, a worker 32 can stand on the B level 30 to work on tires, brakes, etc. as listed above. The B level comprises a pair of walkways 30 at either side of the vehicle 20. The vehicle 20 is positioned at a vehicle location defined by A level support platforms 34 and 36, which may be relatively narrow strips as shown in FIGS. 2 and 3. Fold-out or slide-out platforms 37, capable of sliding longitudinally along the vehicle for desired positioning, preferably are included at the outer edges of the support platforms 34 and 36 as seen in FIG. 2 and also FIG. 5. These can be similar to those included in the Autop system referenced above. The B level platforms 30 are positioned to left and right and beneath the A level platforms 34, 36, providing work areas on either side of the vehicle particularly as shown in FIG. 3. FIG. 5 also reveals one of these level B platforms 30 clearly.

The next level down is the third level or level C, shown at 38 in the drawings. At the C level an automotive servicing person 40 is able conveniently to work on the underside of the car, for the tasks listed above. This C level is about 3 feet (approx. 90 cm) below the B level, and is substantially centered at the vehicle location, directly below the vehicle 20 and an access opening 42 below the vehicle and between the left and right vehicle support platforms 34, 36.

The floor 14 of the building provides a fourth or D level as shown in the drawings. At this level, as shown in FIGS. 1, 3 and 5, service personnel can conveniently access tools, parts and equipment, located in shelves 44, drawers 46 and cabinets 48 which form components of the modularly assembled servicing unit or apparatus 24. Equipment and machinery for performing various operations on automotive components are also located at the D level, to be accessed from the floor of the building, conveniently for multiple vehicle servicing units 24.

Figure 4:
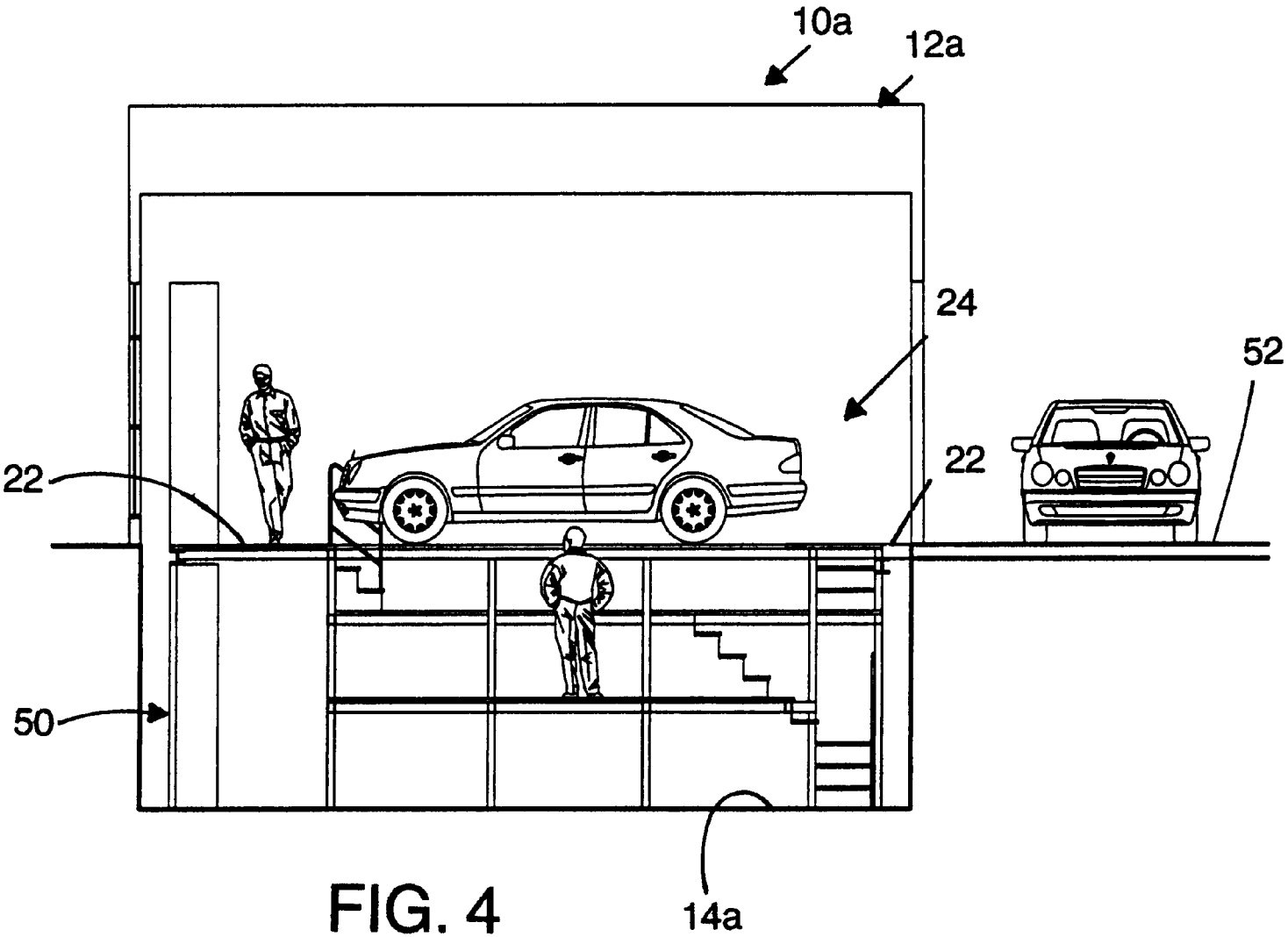
FIG. 4 is a view similar to FIG. 1, but showing a facility in a building having a basement.

FIG. 4 shows a facility 10*a* similar to that of FIGS. 1–3, but in a building 12*a* which has a basement 50. In this case the units 24 rest on the building's basement floor 14*a* as shown, with the A level 22 located at or near the ground level 52 outside the building.

Figure 5A:
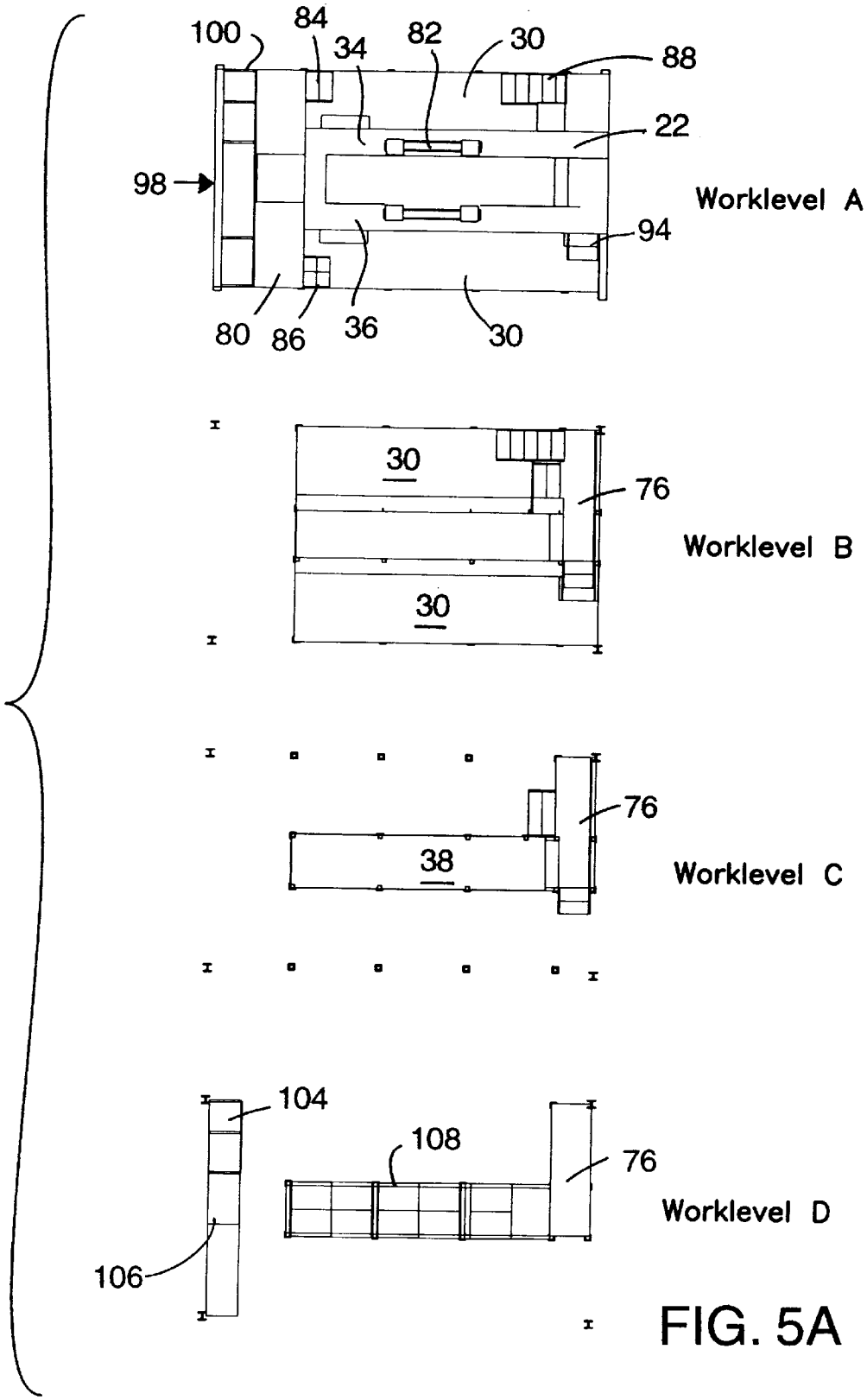
FIG. 5A is a schematic plan view showing relationship of four different levels of the apparatus and system of the invention.

FIG. 5A shows schematically the four work levels A–D or 22, 30, 38 and 14, in plan view and as they relate to each other, helping to show the relationship of the levels as in FIG. 5.

Figure 6:
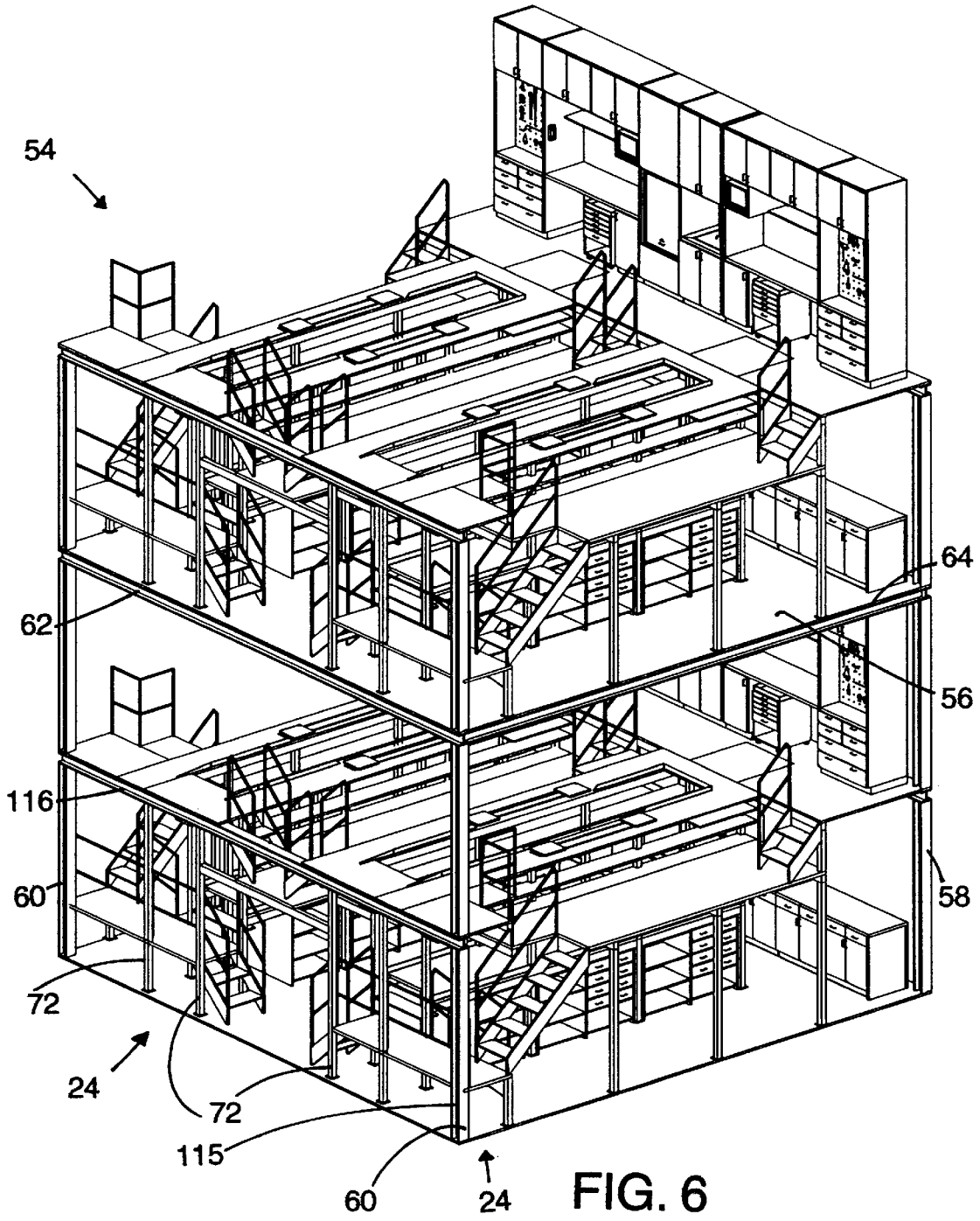
FIG. 6 is a perspective view showing a facility, or a portion of a facility, using side-by-side and stacked units of the type generally shown in FIG. 5.
Figure 7:
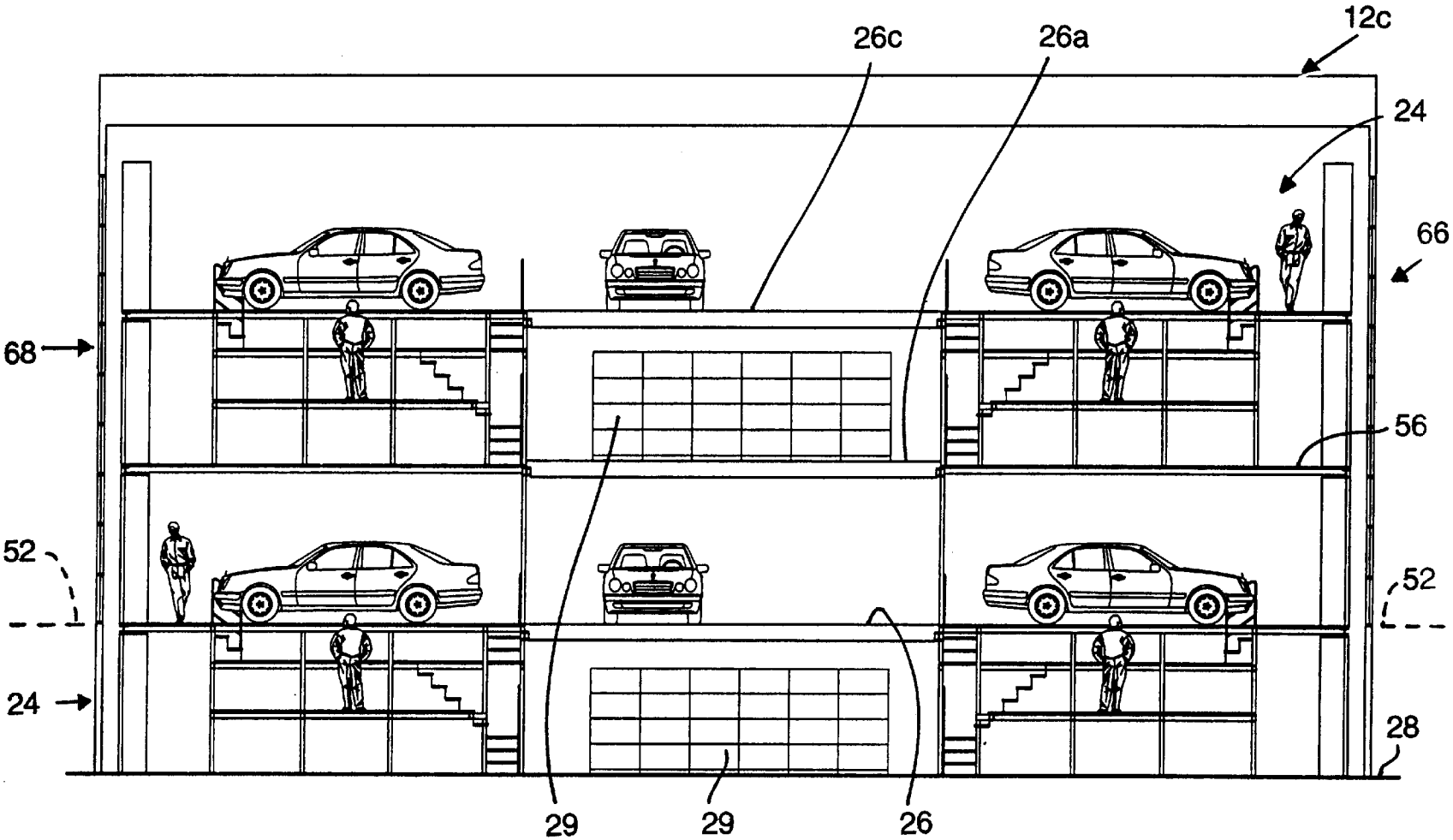
FIG. 7 is an elevation view in section, similar to FIG. 1 but showing a stacked facility, two units in height.

FIGS. 6 and 7 show stacking of the units 24. Both drawings are somewhat schematic, with FIG. 6 showing a facility 54 with units 24 assembled side-by-side and stacked two tiers high. As can be seen from the drawing, this requires inclusion of an additional floor 56, supported on main vertical frame members 58 and 60 at back and front, and horizontal edge beams 62 and 64.

In FIG. 7 a facility 66 is shown in elevation, generally similar to what is shown in FIG. 1 but in a taller building 12*c*, accommodating the units 24 two tiers high. As indicated, the upper units 24 include a floor 56 as in FIG. 6, and in this arrangement a floor section 26*a* is suspended between rows of the units 24 to provide a continuing floor at the level of the floor 56, serving as a D level or fourth, lower most level for the upper tier 68. An additional such suspended floor section 26*c* is shown at the A or upper level of the upper tier 68, this platform being for entry and manipulation of cars to be put on the upper tier units 24. Storage units 29 are also shown at both tiers, and these are similar to what is shown in FIG. 1. The ground is shown at 28 for an above-ground floor, but indicated alternatively at 52 for a building with a basement.

Figure 8:
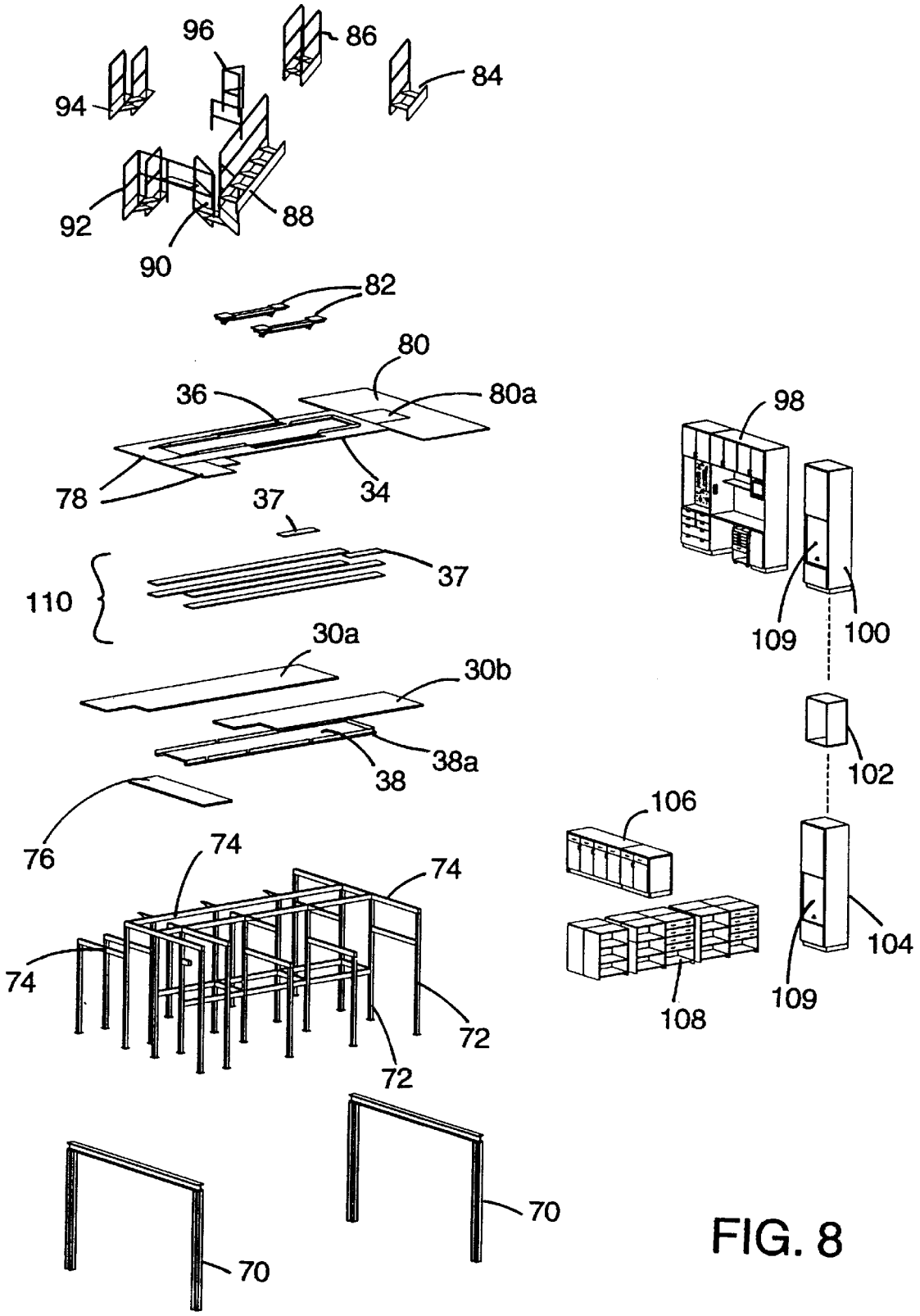
FIG. 8 is an exploded perspective view indicating components of a modular, field-erectable unit.
Figure 8A:
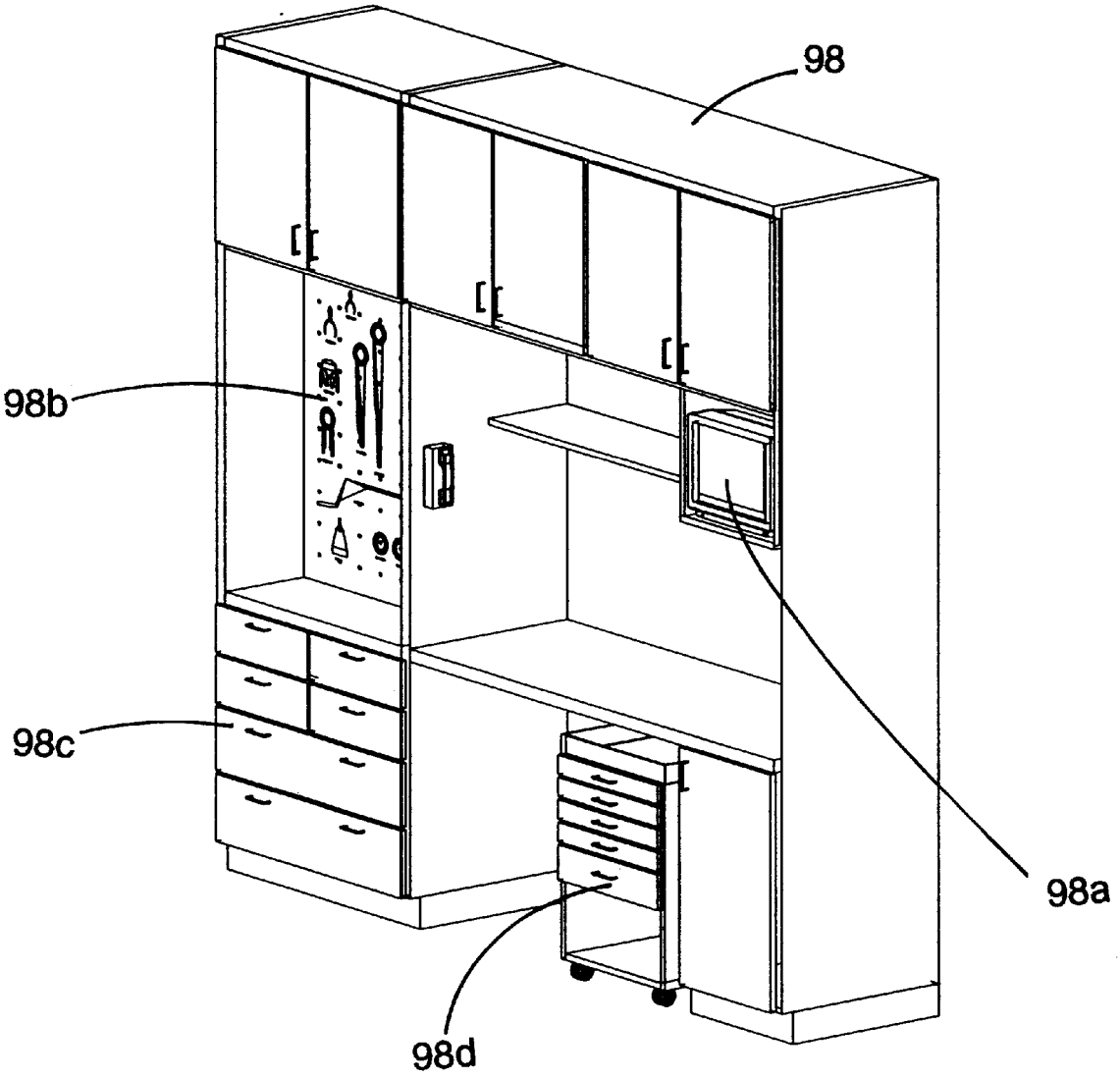
FIG. 8A is an enlarged perspective view showing a cabinet/work station also shown in FIG. 3A, 5 and 8.

FIGS. 8–11 show components and details of construction for the modular units 24 such as shown in FIGS. 5 and 6. In FIG. 8 are shown a collection of components which make up a unit as in FIG. 5. These include a pair of U-shaped frames 70, a series of vertical and horizontal structural components 72 and 74, platforms 30*a* and 30*b* which make up the B level walkways 30, a C-level platform 38, with a structural perimeter 38*a*, a landing 76 which is positioned between stair steps in FIG. 5, narrow vehicle platforms 34 and 36 for the A level, additional A level platforms 78 and 80, left and right vehicle lifts 82, stair and rail components 84, 86, 88, 90, 92, 94 and 96, cabinets 98, 100, 104, 106 and 108, and shelf components 110 which can be secured to the vertical frame members 72 for tool and parts storage for the worker on the C level. FIG. 8A shows the cabinet 98 larger, revealing a testing monitor 98*a*, tool storage board 98*b*, tool drawers 98*c*, rolling tool case 98*d*, etc., all within reach of a technician working on a car's engine. An item 102 shown between the upper and lower cabinets 100, 104 is a dumbwaiter for movement between the A and D levels, accessible from cabinet doors 109 (see also FIG. 5). The sliding platforms 37 for level A are also shown in FIG. 8. Essentially all of these components can be seen in their respective assembled positions in FIG. 5. The shelves 110 are connected to vertical structural members 72 framing the C-level platform, in any appropriate manner.

FIGS. 5 and 8 show that the platform component 80, which is adjacent to tool and parts cabinetry 98 and 100 and located for access to the front end of the car, has a removable panel 80*a*. This is for lowering parts, including components as large as an engine, down through level A and past levels B and C to the D level, i.e. the floor 14, for machining, servicing, etc. This can be accomplished for heavy components using a ceiling hoist (not shown) secured to the roof/ceiling 18 as in FIGS. 1–4. For smaller parts the dumbwaiter 102 is used.

Figure 9:
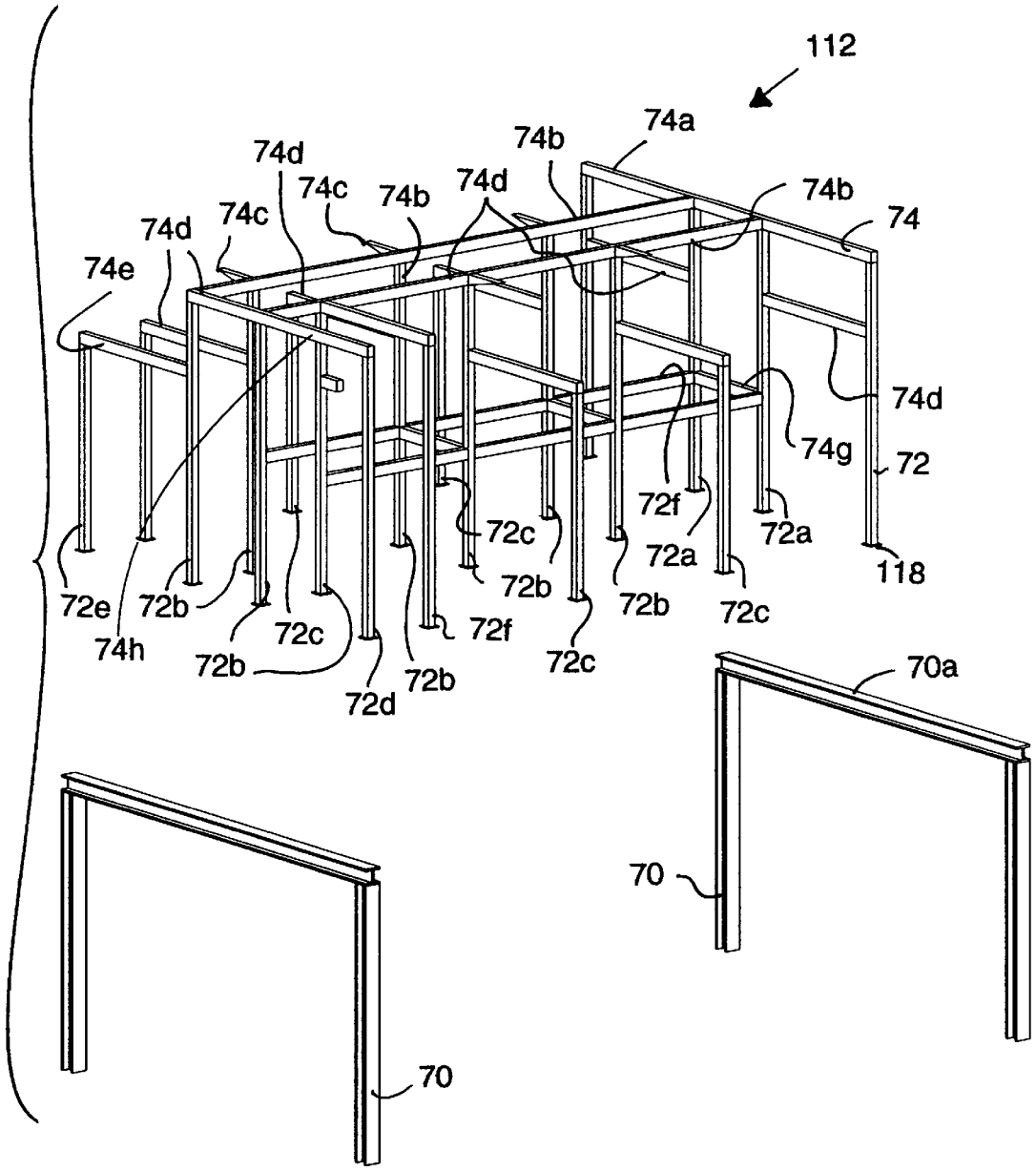
FIG. 9 is a perspective, exploded view showing some of the components in greater detail.
Figure 10:
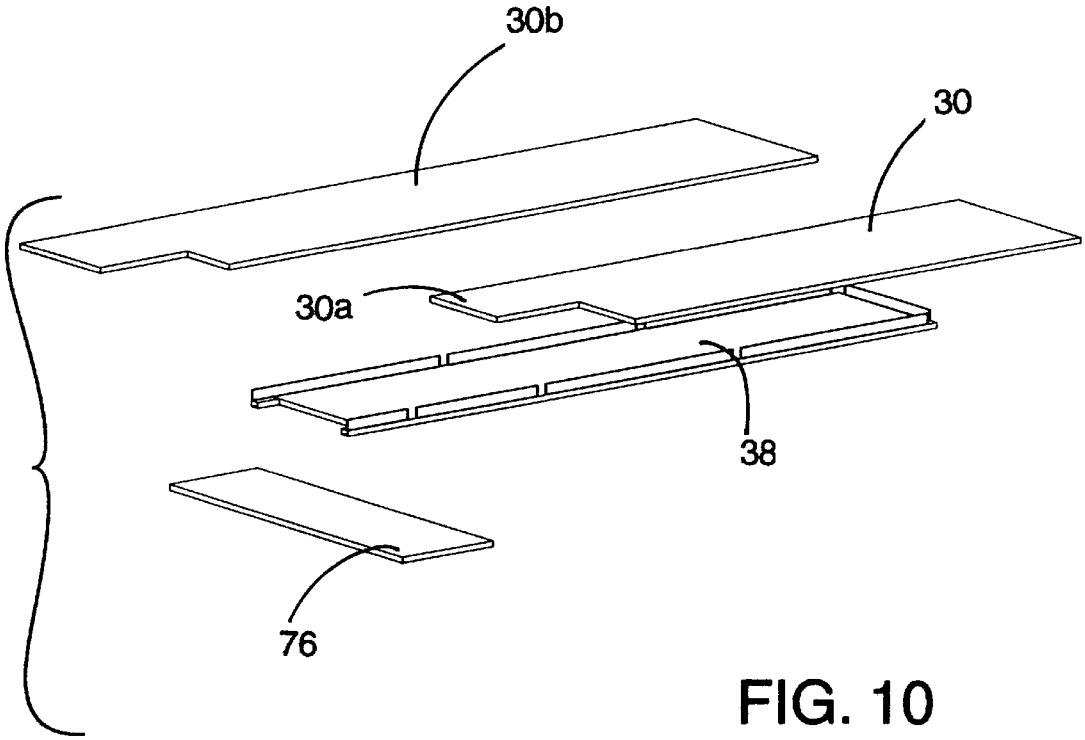
FIG. 10 is an exploded, perspective view showing some floor components of a unit.
Figure 11:
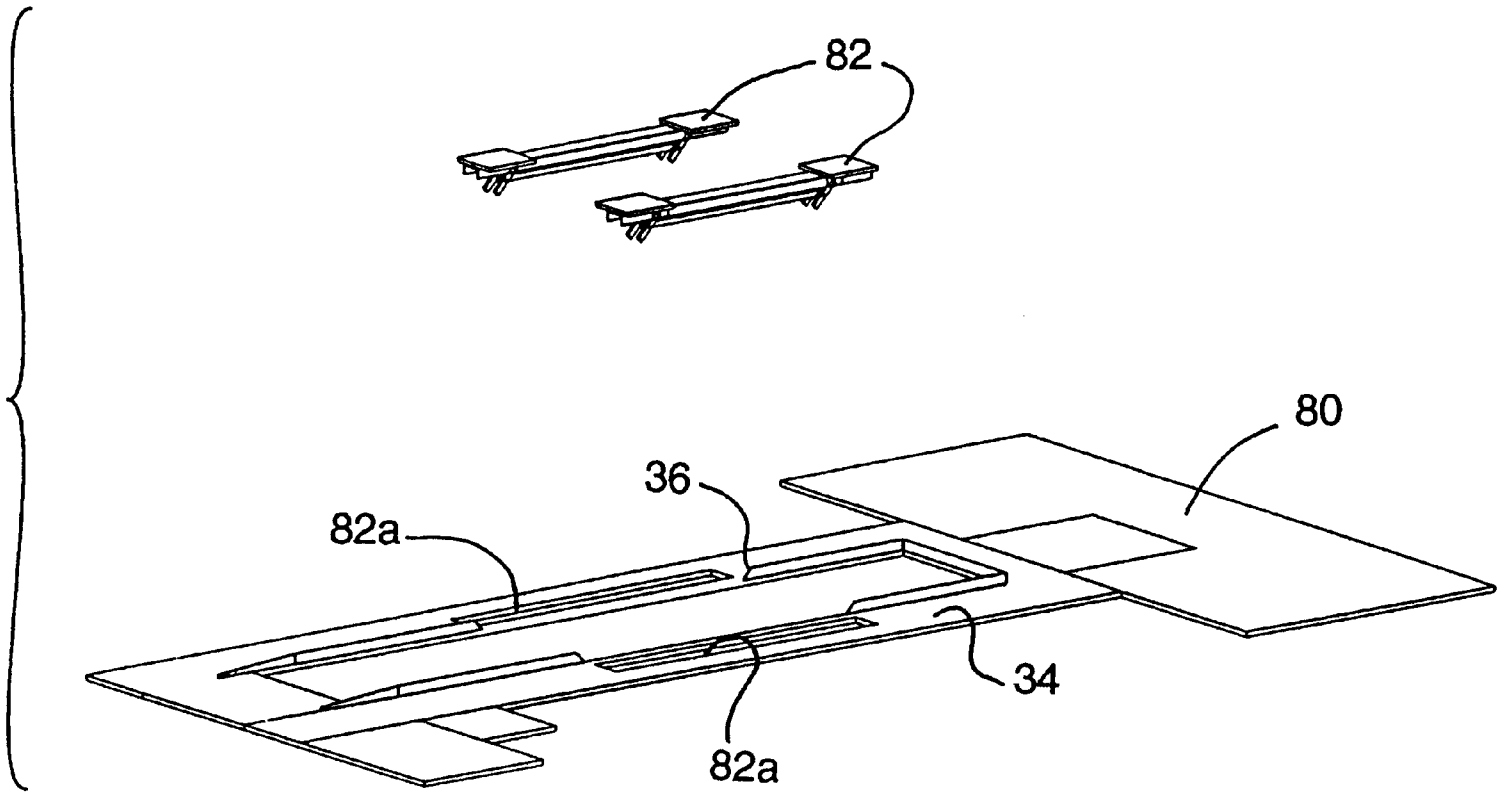
FIG. 11 is an exploded view showing level A floor platforms.

Several of the major components are shown larger in FIGS. 9, 10 and 11. FIG. 9 shows the U-shaped structural frames 70, as well as all the vertical and horizontal structural components 72 and 74 of the modular unit, in larger scale. The figure should be reviewed in combination with FIG. 5 and sometimes FIGS. 1–3, as well as FIG. 8. FIG. 9 shows that the unit comprises in large part a framework 112 formed of the vertical and horizontal structural members 72 and 74. These members, preferably of steel, are as large and deep in cross section as needed for the weight to be carried. The vertical members 72, as well as the frames 70, comprise floor-bearing members, and they may or may not have added or formed floor-bearing "feet" 118 at bottom ends. In the case of stacking of the service units, the U-shaped structure 70 will generally be larger at the lower level. Also, as can be seen from FIGS. 6 and 3, for example, the U-shaped structural member 70 can be replaced with different members when the servicing units are assembled side-by-side. FIG. 6 shows, at the lower level, main structural uprights 115 and a beam 116 spanning between the uprights, with other vertical structural members 72 supporting the beam 116 between its ends. These main structural members 70, 115 and 116 can be replaced or configured as needed for the size and arrangement of the facility being assembled.

FIG. 9 shows one preferred structural assembly for a unit 24 of the system, in a partly assembled frame 112. The frame is shown without the decking or platform components 80, 34, 36, 78, 30, 38, etc. Those are shown primarily in FIGS. 10 and 11, which should be considered in conjunction with FIG. 9 and FIG. 5.

As shown in FIG. 9, the vertical structural components 72 preferably have some form of pad or foot 118 at the lower end of each such member, for bearing against the building floor. As seen in FIGS. 5 and 9, the upper or A level is supported at the deeper or wall end of the unit by beams 70*a* and 74*a*, with the work platform 80, on which the cabinets 98 and 100 are located, spanning between those horizontal beams. Additional horizontal beams or joists can span between the beams 74*a* and 70*a* if needed, depending on the strength of the platform 80 and its spanning distance.

The narrow platforms 34 and 36 on which the car rests, defining the vehicle location, are supported in this embodiment by horizontal beams 74*b* running in the longitudinal direction relative to the vehicle location, and these extend between the transverse beam 74*a*, at the location of vertical members 72*a*, and a pair of opposite-end vertical members 72*b* as shown. Additional vertical column members 72*b*, for intermediate support of the vehicle area of level A, can be provided, on both sides of the vehicle location, as shown. The longitudinal beams 74*b* are rigidly attached to the tops of all of these vertical members 72*b*, and they are of sufficient size such that cantilevered brackets or joist members 74*c* can be used to extend in both transverse directions, in opposed transverse directions from the two beams 74*b*, as shown, to provide adequate support for the vehicle tracks or narrow platforms 34, 36 (FIGS. 5 and 11).

For level B, a series of horizontal joists 74*d* extend as shown, between vertical members. These vertical members include legs 72*c* positioned at left and right sides of the frame. FIG. 9 shows several such joists 74*d* supported in this way, for supporting the B-level platform 30 shown in FIG. 10.

At the left side of the assembly shown in FIG. 9, the remaining platform of the B level is supported. As shown in FIG. 10, this left side platform 30*b* is of greater length than the right platform 30 because of different stair arrangements, with the stair steps 94 located in this area. The platform 30*b* rests on joists 74*d* similar to those on the right side, but with an end joist 74*e* supporting the end of the platform, that joist being connected to a column 72*b* which, together with a similar column 72*b*, may be affixed to and support the U-shaped frame 70 in the assembly, as shown in FIG. 5, although FIG. 9 shows a beam 74*h* extending across the end of the unit, connected to two columns 72*b* and a column 72*d*, and which may be connected to the U-shaped frame 70. Other beam arrangements can be used for different facility configurations, in lieu of the frame 70. The left end of the joist 74*e* shown in FIG. 9 can be framed into the U-shaped member 70 or it can have its own column support 72*e*.

The C level of the servicing unit, indicated as a platform 38 in FIG. 10 and FIG. 5, is supported by lower horizontal framing members or joists 74*f* (longitudinal) and 74*g* (transverse). These are shown connected to the upright columns 72*a* and 72*b* in FIG. 9.

A column 72*f* is shown in FIG. 9 for support of a stair landing 76 and stair 88 shown in FIG. 5, the landing also seen in FIG. 10. As shown in FIG. 5, the landing 76 is also supported by the U-shaped frame 70, columns 72*d* and 72*b*.

The on-site connection of structural components in the kit of parts which comprises the invention is an important feature. It is important that these connections be non-permanent, in that they are assembled and are capable of dismantling, e.g. using tools. The precise type of dismantlable connections is not important, but only that the connections be made on site, in a modular and efficient manner, with the connections capable of later disassembly. Thus, welding should not be used. Bolts may be used, with nuts or threaded apertures, as removable fasteners for erecting the system. Other examples are keyed, wedge type inserts, tapered pins, or pinned tube-in-socket, pinned mortise and tenon, or other types of connectors.

FIG. 11 shows the vehicle jacks 82 for the A level. These are shown exploded along with the A level platforms 34, 36 and 80. As indicated, these jacks, which are preferably hydraulic or screw type jacks capable of raising the vehicle a few inches, are seated into openings 82*a* in the car supporting tracks or platforms 34, 36. Those platforms 34, 36 can be integral as shown in FIG. 11.

FIGS. 12–14 are schematic diagrams showing blocks representing the modular vehicle servicing units 24. These are different arrangements within which facilities can be assembled, and it should be understood that any width can be achieved, even though widths of only two units are shown in these figures.

FIG. 12 shows a simple side-by-side arrangement, which is similar to the lower half of the facility shown in FIG. 6. FIG. 13 shows the arrangement of FIG. 6. Again, the number of units can be considerably more than two in the width direction. The A level is shown at A in these diagrams.

FIG. 14 indicates a facility as in FIG. 12 but with the side-by-side units doubled across an aisle or corridor, with an elevated corridor platform shown at 26, equivalent to the corridor platform 26 shown in FIG. 1. FIG. 15 shows a similar arrangement, but with the units stacked two tiers high as in FIG. 13. Ingress and egress for cars can be by any of several means—in a building with a basement (FIG. 4), by ground-level access; otherwise by ramps, side-hill entrance at A level, or a lift.

Figure 16A:
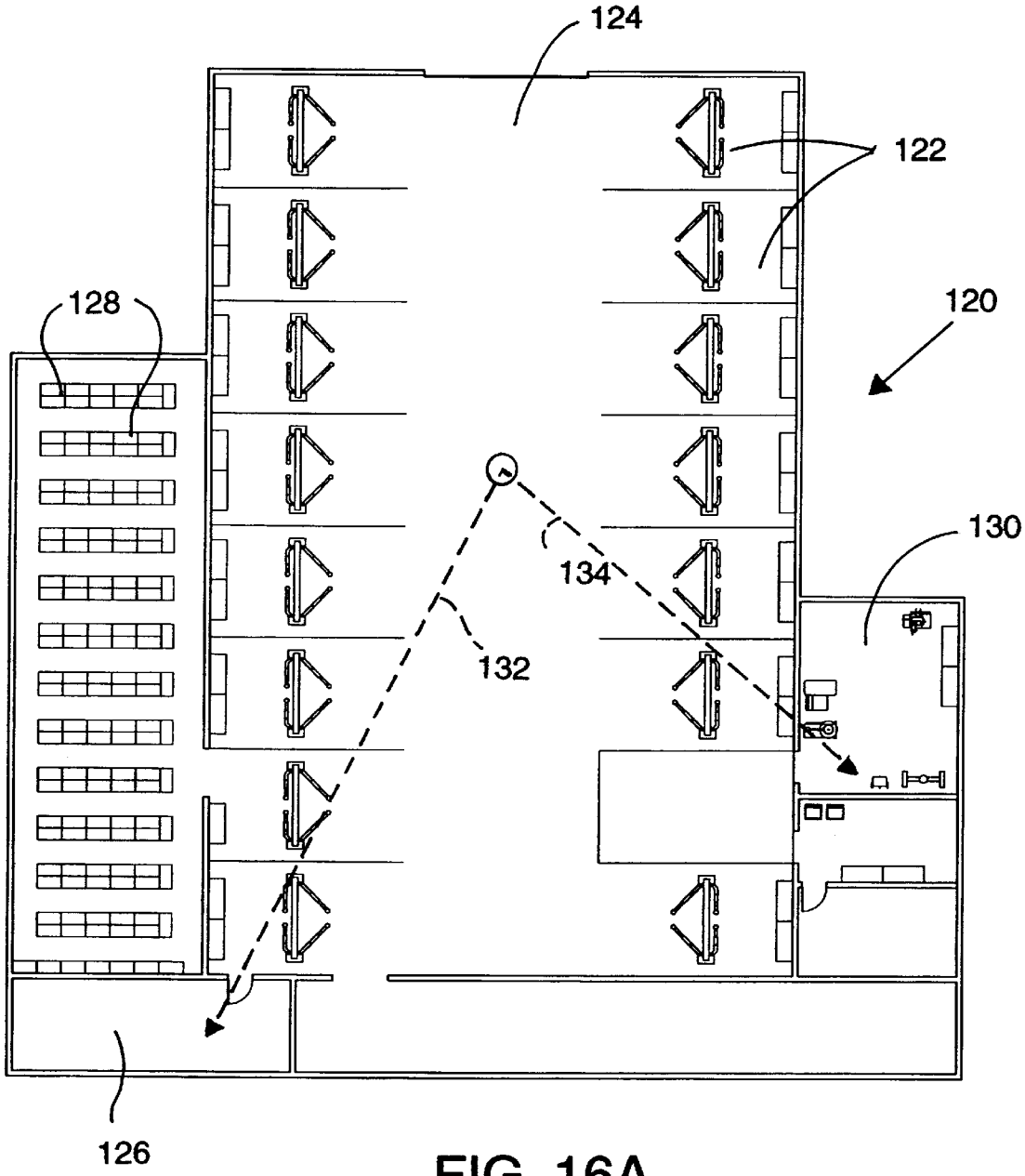
FIG. 16A PRIOR ART
FIGS. 16A–16D are schematic representations in plan and sectional elevation, comparing the system of the invention to a conventional shop layout.
Figure 16B:
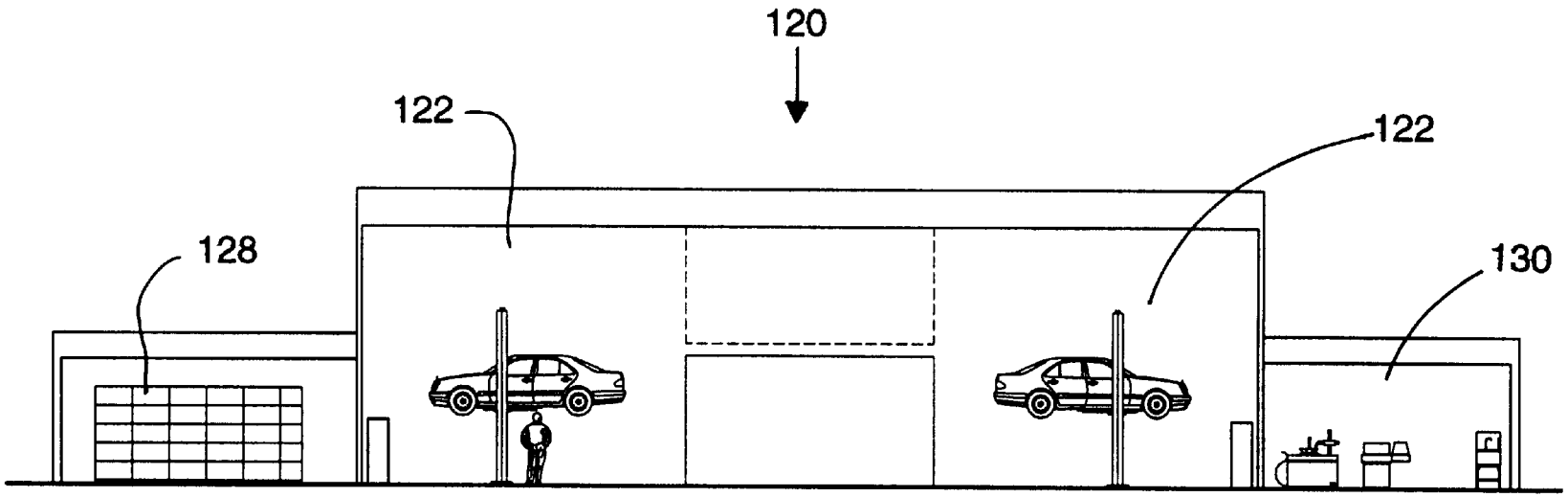
FIG. 16B PRIOR ART

FIGS. 16A–16D show a comparison of a conventional automotive workshop and the multi-level service system of the invention, with system layouts and employee access to equipment, tools and parts compared. All views are schematic, with the plan and elevational section views of FIGS. 16A and 16B representing prior art. These views, along with the table below, demonstrate that a shop with 15 work stalls in a conventional system is comparable to a shop with only 6 stalls in the multi-level system of the invention. In the conventional shop 120, the 15 work stalls 122 are arrayed on opposite sides of a central service drive 124, in the conventional manner. A parts desk or parts issue center is located at 126, and parts are stored at 128. This is remote from the work stalls in most cases. The conventional shop 120 has equipment, tools and mechanical support, such as machinery for surfacing brakes or working on engines, at a single location 130. The dashed lines 132, 134 show the average walking distance required for a service worker to obtain parts and to use the equipment at 130.

Figure 16C:
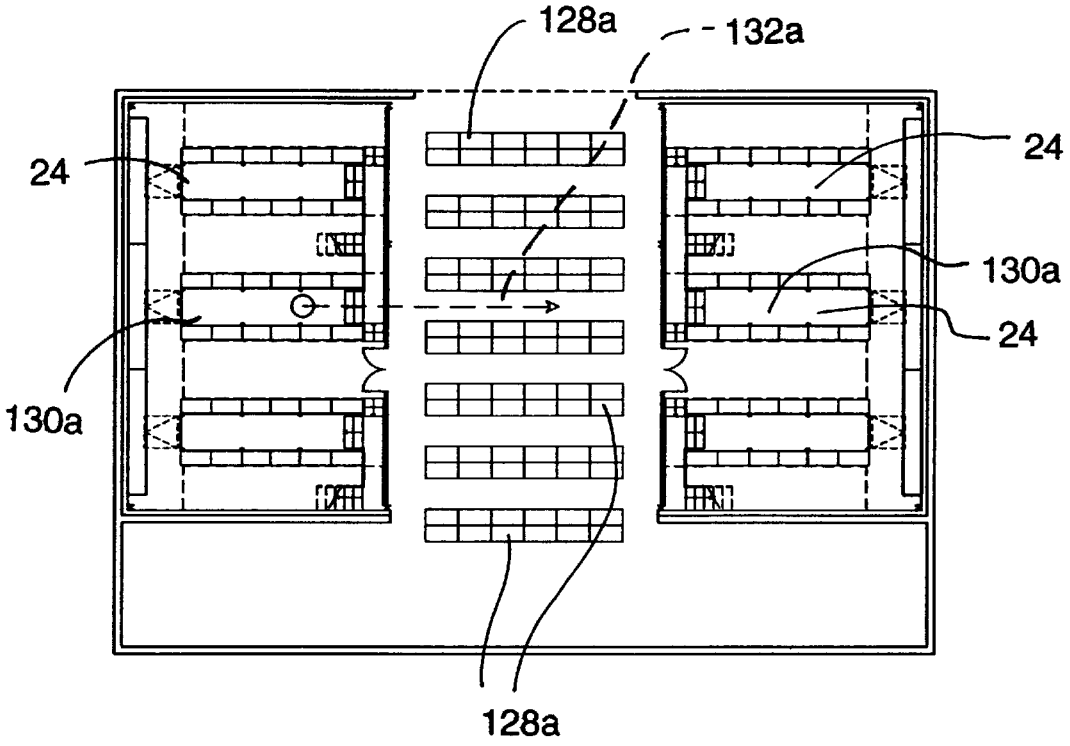
Figure 16D:
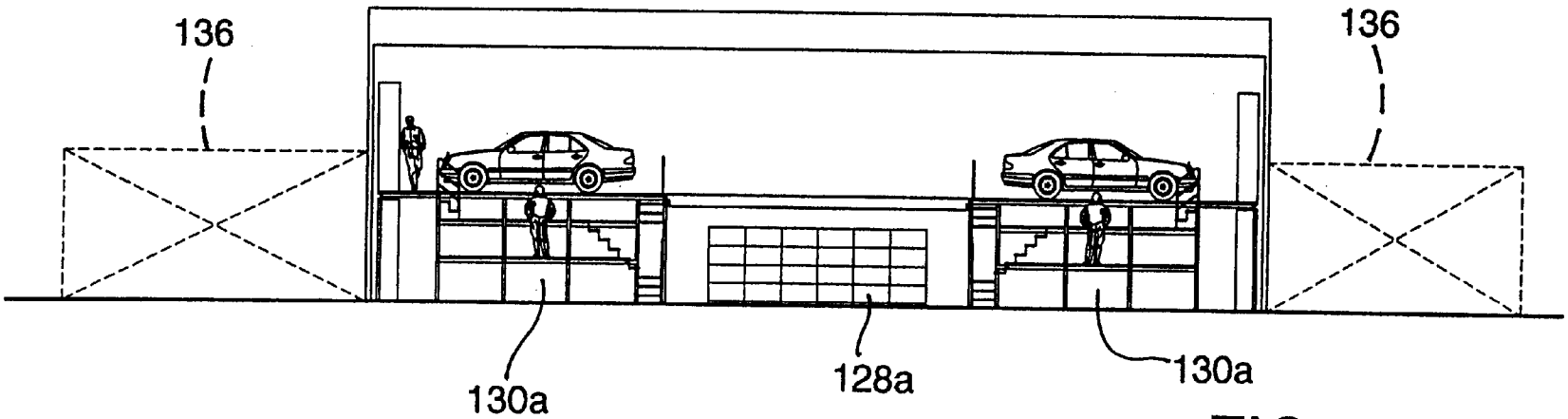

FIGS. 16C and 16D, depicting the system of the invention, show the convenient locating of parts in cabinets 128*a* on the D level or lowest level, located close to the six multi-level servicing units 24 and under the center aisle or drive between the two sides of the facility as shown. The equipment, tools and mechanical support are located also on the D or lowest level in the system of the invention, such as at 130*a* as shown in FIG. 16C, in this case near the center two work stalls 24. A dashed line 132*a* in FIG. 16C indicates the short walking distance of a technician to secure parts, with very little walking distance also required for access to equipment and tools. The dashed outlines 136 in FIG. 16D indicate portions of the conventional building which are not needed for the system of the invention.

The table below shows an example comparison between a conventional workshop and a multi-level service system of the invention, with indication of savings in ground area required and total building volume, as well as approximate average walking distance and time required per work order and for obtaining parts. These figures are approximate, but indicate the very significant increase in efficiency afforded by the multi-level service system of the invention.

CONVENTIONAL WORK SHOP VS. MULTI-LEVEL SERVICE SYSTEM

| Conventional Work Shop | Multi-level Service System | Difference/ Saving |
|---|---|---|
| EXAMPLE: 15 TECHNICIAN SERVICE OPERATION | | |
| 15 Work stalls w/1 technician per stall = 15 technicians<br>125 SF of parts/ conventional work stall = 1875 SF | 6 Work stalls w/2.5 technicians per stall = 15 technicians<br>125 SF of parts/ conventional work stall = 1875 SF | |
| GROUND AREA (footprint) | | |
| 9026 SF | 2880 SF | 6147 SF<br>Or 68% |
| VOLUME (enclosed space) | | |
| 7056 SF × 20 = 141,120 Cu FT | 2880 SF × 20 = 57,600 Cu FT | |
| 1971 SF × 12 = 24,020 Cu FT<br>Total = 165,140 Cu FT | | 107,540 Cu Ft<br>Or 65% |
| TECHNICIAN TIME | | |
| Walking distance<br>240 FT per work order | 40 FT per work order | 6:1 |
| Parts issuing time<br>10 min. | 5 min. | 2:1 |

The above described preferred embodiments are intended to illustrate the principles of the invention, but not to limit its scope. Other embodiments and variations to this preferred embodiment will be apparent to those skilled in the art and may be made without departing from the spirit and scope of the invention.

We claim:

1. A multi-level vehicle servicing apparatus for installation on a floor of a building to achieve high space utilization without need for a work pit in the building floor, comprising:

a frame assembled from frame members and including floor-bearing members for bearing against a building floor to support the frame, a vehicle support and drive-on platform connected to and supported on the frame to define a first work level on which a vehicle is supported, sufficiently high above the building floor to enable a worker to work in a standing position on the underside of the vehicle and including an opening in the platform narrower than a vehicle's wheel spacing and defining a vehicle location on the platform, and the first work level including an area permitting a worker to stand in front of a vehicle positioned at said vehicle location to work on components under the hood of the vehicle, second platform means connected to and supported on the frame and defining a second work level lower than the first work level for permitting a standing worker to comfortably work on wheels, tires and brakes of a vehicle, from a side of the vehicle, vehicle lift means for enabling elevation of a vehicle slightly above the first work level, for such work on wheels, tires and brakes, third platform means connected to the frame and defining a third work level lower than the second work level, for supporting a worker directly beneath a vehicle for work on the underside of the vehicle, and access means providing access for workers to all levels.

2. The apparatus of claim 1, wherein said frame members of the frame are secured together by removable fasteners such that the facility is site-erectable and capable of dismantling and removal essentially without modification of a building or damage to the building floor.

3. The apparatus of claim 2, wherein the removable fasteners comprise bolts and nuts.

4. The apparatus of claim 1, wherein said frame members of the frame are secured together by dismantlable connections.

5. The apparatus of claim 1, wherein said access means comprises stair means connecting the building floor and the third, second, and first work levels.

6. The apparatus of claim 1, wherein parts, automotive servicing machinery and tools are located beneath the first work level and closely accessible to a worker on the building floor.

7. The apparatus of claim 1, further including a removable platform panel in the first work level platform, just in front of the vehicle location, for lowering and raising automotive components between the first work level.

8. The apparatus of claim 1, wherein the building has walls and wherein the frame is not connected to building walls.

9. The apparatus of claim 1, wherein said building floor comprises a ground floor.

10. The apparatus of claim 1, wherein the vehicle lift means comprises a pair of hydraulic lifts connected to the frame at the first work level, positioned to be under each of left and right sides of a vehicle positioned at said vehicle location.

11. The apparatus of claim 1, wherein the second platform means includes second platform portions at each side of the vehicle location.

12. The apparatus of claim 1, wherein the third platform means is above the floor of the building.

13. An automobile servicing facility including a building within which are located a plurality of vehicle servicing apparatus as defined in claim 1, positioned side-by-side such that vehicles located at said vehicle positions are generally arranged in parallel, and in which said first work level comprises a generally continuous work level across the plurality of vehicle servicing apparatus except at said openings in the platform defining the vehicle locations and at locations of the second platform means.

14. A method for producing a multi-level vehicle servicing facility which achieves high space utilization in a building without need for work pits in the building floor, comprising:

(a) providing structural members capable of being assembled with removable connections into a frame capable of bearing against a floor mat supporting the weight of a vehicle, (b) providing a plurality of platforms with means for removable connection to the frame, the platforms being arranged to support a vehicle at a highest, or first level, and to support an automotive worker at a position to work on the engine of the vehicle, and including platforms connectable to the frame to form a second level lower than the first, for workers to service wheels, tires and brakes, and including a platform connectable to the frame directly beneath the vehicle, at a third level lower than the second level and appropriate for a worker to stand and service a vehicle from beneath, (c) providing cabinet units capable of storing parts and tools and at least some of the cabinet units capable of connection to the structural members of the frame, (d) providing modular sets of stairs capable of connection to the structural members of the frame to extend between the platforms of different levels, (e) transporting the structural members and platforms and cabinet units in dismantled condition to a building having a building floor without work pits, (f) erecting the structural members on the building floor by connecting the members with connections capable of removal if desired, (g) connecting the platforms to the structural members using removable connections, to erect a vehicle servicing unit with first, second and third levels and with an opening down through the first level for a worker standing on the third level to access the underside of a vehicle, and (h) placing cabinet units on the erected structure, in such a way as to be adjacent to the first, second and third levels for convenience of a worker.

15. The method of claim 14, including erecting the structural members and connecting the platforms such that the third level is above the building floor.

16. The method of claim 14, wherein the step of connecting the members comprises using bolts and nuts to connect the members together and to connect the platforms to the structural members.

17. The method of claim 14, wherein the platforms forming the second level are positioned to each side of the location of the vehicle, to each side of the opening.

18. The method of claim 14, further including providing a removable panel in a platform of the first level, just in front of the vehicle location, for raising and lowering heavy vehicle components to and from the first level.

19. The method of claim 14, including providing a series of such structural members, platforms, cabinet units and stairs, and including erecting a plurality of such vehicle servicing units side-by-side and connected together at the first levels, so as to form a multiple-vehicle servicing facility.

20. The method of claim 19, wherein a plurality of units are erected in parallel on each side of a central vehicle access corridor, thus establishing a vehicle servicing facility with multiple vehicle servicing units on each side of the access corridor.

* * * * *